United States Patent [19]

Rishworth et al.

[11] Patent Number: 5,009,612

[45] Date of Patent: Apr. 23, 1991

[54] MULTI-CONDUCTOR ELECTRICAL CABLE CONNECTOR

[75] Inventors: Paul L. Rishworth, Richmond; Denis L. Rishworth, Knysna Heights, both of South Africa; Daniel A. Dixon, Naperville, Ill.

[73] Assignee: Molex Incorporated, Lisle, Ill.

[21] Appl. No.: 479,302

[22] Filed: Feb. 7, 1990

[51] Int. Cl.[5] ..... H01R 4/24

[52] U.S. Cl. ..... 439/403; 439/417

[58] Field of Search ..... 439/417, 403, 402, 498, 439/492, 746

[56] References Cited

U.S. PATENT DOCUMENTS

| | | | |
|---|---|---|---|
| 3,388,370 | 6/1968 | Elm | 439/402 |
| 3,880,489 | 4/1975 | Dauser | 439/402 |
| 3,923,362 | 12/1975 | Dunn et al. | 439/403 |
| 4,027,941 | 6/1977 | Narozny | 439/402 |
| 4,095,862 | 6/1978 | Hatch | 439/402 |
| 4,127,312 | 11/1978 | Fleishhacker et al. | 439/403 |
| 4,265,504 | 5/1981 | Burns | 439/746 |
| 4,552,429 | 11/1985 | van Alst | 439/403 |
| 4,691,977 | 9/1987 | Marzili et al. | 439/417 |
| 4,902,243 | 2/1990 | Davis | 439/417 |

FOREIGN PATENT DOCUMENTS 1070403 1/1980 Canada .

0150593 12/1984 European Pat. Off. .

*Primary Examiner*—Gary F. Paumen
*Assistant Examiner*—Kevin J. Carroll
*Attorney, Agent, or Firm*—Louis A. Hecht; Stephen Z. Weiss; A. A. Tirva

[57] ABSTRACT

This invention relates to an electrical conductor cable connector which includes a housing made from an electrical insulating material, having side walls which define an enclosure, a lower portion which extends between the side walls to define an open topped compartment in the housing on one side of the lower portion, a plurality of suitably spaced conductor engaging elements in and extending from the lower portion into the compartment with each element including a portion in the floor of the housing for electrically connecting an electrical conductor in a cable located in the lower portion to the conductor engaging element, a press member which is made from an electrical insulating material, for pressing a conductor ribbon tape cable into the compartment and the conductors which are carried by the tape into electrical engagement with the conductor engaging elements, means for clamping the ribbon tape in the compartment between the conductor engaging elements and each tape exit from the housing and a catch arrangement for locking the press member in the compartment to hold the tape clamped in the housing.

8 Claims, 2 Drawing Sheets

MULTI-CONDUCTOR ELECTRICAL CABLE CONNECTOR

FIELD OF THE INVENTION

This invention relates to an electrical conductor connector for connecting the conductors oF electrical cables to each other and more particularly to so connecting the conductors of multi-strand ribbon tape cables.

BACKGROUND TO THE INVENTION

Electrical conductor connectors of the type with which this invention is concerned are well known. Many of the known connectors such as those disclosed in U.S. Pat. No. 4,552,428, European patent No. 0150593 and Canadian patent No. 1070403 all to AMP Incorporated include terminal carriers which have a removable cover which is, in one way or another, engaged with the terminal carrier to hold conductors in the connector in engagement with the terminals of the terminal carrier. Problems that frequently arise with conductor connectors of the above type are that the conductors, whether single conductors or contained in ribbon tapes, may easily be torn from the terminals in the connectors by stress applied to the conductors on the outside of the connector with which they are engaged to cause electrical disconnection of the conductors with the terminals and more often than not irreparable damage to the terminals themselves. A second problem with the known conductor connectors is that the covers for holding the conductors on the terminal carriers are components which are separate from the carriers and so easily become misplaced and prior to location over conductors engaged with the carrier terminals permit, in hostile environmental conditions such as in mines and in many industrial applications, the ingress of particulate matter and other dirt on to or into the terminal carriers with the possible consequence that the covers may be improperly located and in time become dislodged from the terminal carriers and further that the dirt may interfere with the proper electrical connection of the conductors with the terminals on those connectors in which the covers press the conductors into electrical engagement with the terminals on the terminal carriers.

OBJECT OF THE INVENTION

It is the object of this invention to provide an electrical conductor connector which will at least minimize the problems discussed above with known conductor connectors.

SUMMARY OF THE INVENTION

An electrical conductor cable connector according to the invention includes a housing, made from an electrical insulating material, having side walls which between them define an enclosure, a lower portion which extends between the side walls to define an open topped compartment in the housing a partition member, a plurality of suitably spaced conductor engaging elements in and extending from the partition member into the compartment with each element including a portion in the lower portion of the housing for electrically connecting an electrical conductor in a cable located in the lower portion to the conductor engaging element, a press member which is made from an electrical insulating material, for pressing a conductor ribbon tape cable into the compartment, and the conductors which are carried by the tape into electrical engagement with the conductor engaging elements, means for clamping the ribbon tape in the compartment between the conductor engaging elements and the/or each tape exit from the housing and a catch arrangement for locking the press member in the compartment to hold the tape clamped in the housing.

Further according to the invention each conductor engaging element includes a first blade which extends perpendicularly from the partition member into the compartment with the portion of each conductor engaging element located in the lower partition having a second oppositely directed blade extended from it, each blade of each conductor engaging element including a cutting edge for cutting the ribbon tape insulation on a conductor when pressed onto the blade and a slot for electrically engaging a conductor in the insulation when cut by the blade with the press member including slots for receiving the blades which project from the lower portion when the ribbon tape is pressed by the press member into the compartment over the blades.

In one form of the invention the lower portion of the housing includes, on its side opposite to that having the compartment, a recess defining a second compartment into which the second blades of the conductor engaging elements project with the connector including a second press member, having blade slots, for pressing a second conductor ribbon tape into the second compartment and the tape conductors, through the cut tape insulation, into electrical engagement with the blade slots and a catch arrangement for locking the second press member in the second compartment. Conveniently the second compartment includes clamping means for clamping the ribbon tape to the housing in a position between the conductor element blades in the second compartment and the/or each tape exit from the compartment.

The ribbon tape clamping means may be mating tape direction changing formations between the housing in the/or each compartment and the/or each press member between which the/or each ribbon tape is clamped in use.

Still further according to the invention the catch arrangement for holding the/or each press member in the/or each compartment is a resiliently deformable male formation on a surFace of one of the components and a recess in an adjacent surface of the other into which the male formation is pressed to lock the components together when the/or each press member is fully pressed into the/or each compartment.

In a preferred form of the invention the housing includes a ribbon tape entry slot which extends through the wall of at least the first compartment above the conductor engaging elements and the cable connector includes in the compartment, a first catch arrangement for holding the press member in the compartment clear of the tape entry slot and a second catch arrangement For holding the press member in pressure contact with the tape when pressed into clamping contact with the tape.

Conveniently one or both compartments may be filled with a flowable liquid sealant.

In many electrical circuit applications in which the cable connector will find application it will be convenient to open a conductor in the connector and the housing may, for this purpose, include a cutting blade which extends from the floor or press member into a compartment for cutting and so open circuiting a pre-selected cable conductor when pressed by the press member into the compartment with a conductor engaging element on at least one side of the cutting blade in the path of the cut conductor through the housing for electrically engaging the conductor on one side of the blade. Preferably, the base of the press member and the lower portion which carries a cutting blade includes mating formations in the cut conductor path through the housing on one side of the cutting blade for deforming the cut conductor to shorten it out of electrical contact with the cutting blade.

DETAILED DESCRIPTION OF THE DRAWINGS

Figure 1:
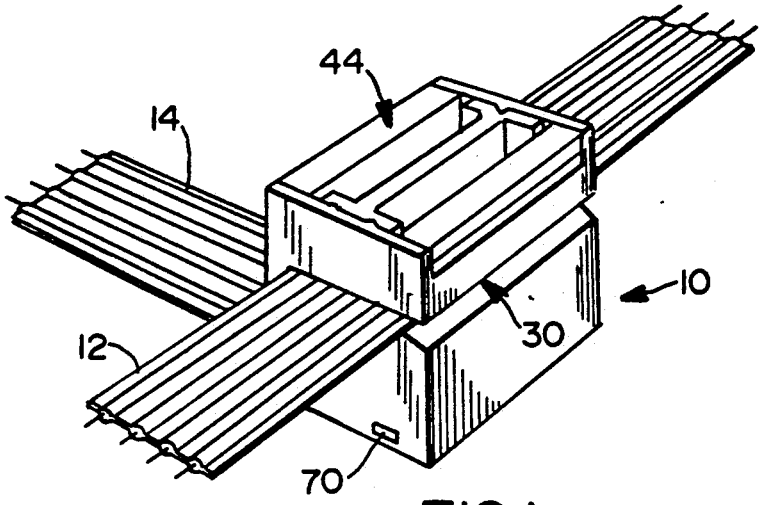
Figure 5:
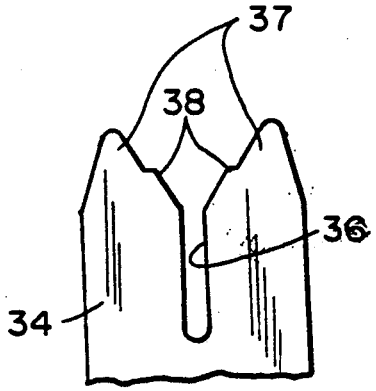
Figure 11:
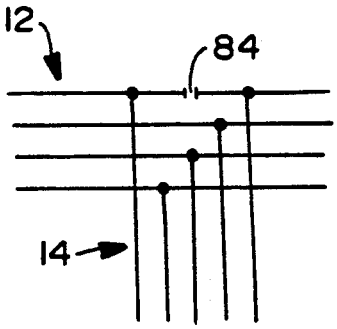
Figure 4:
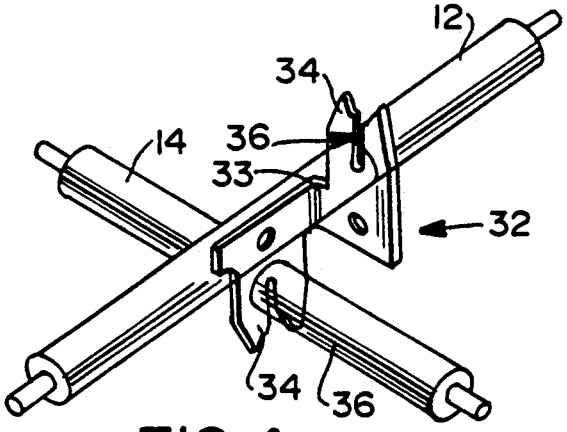
Figure 12:
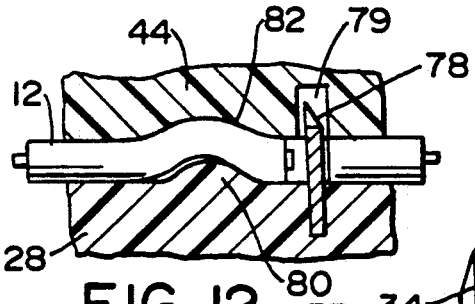
Figure 6:
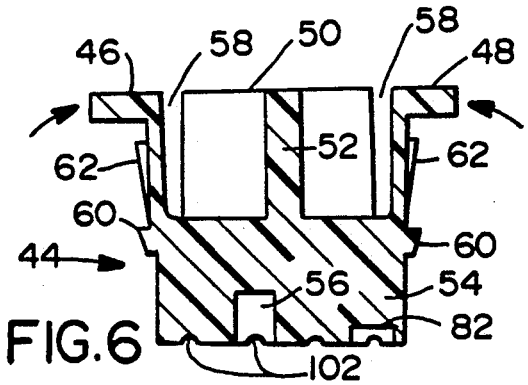
Figure 7:
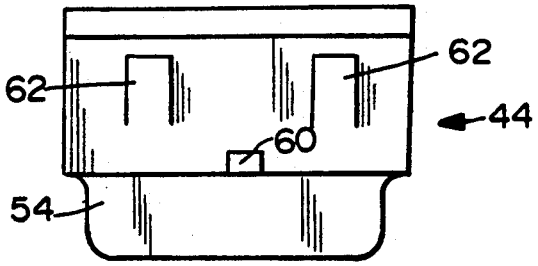
Figure 2:
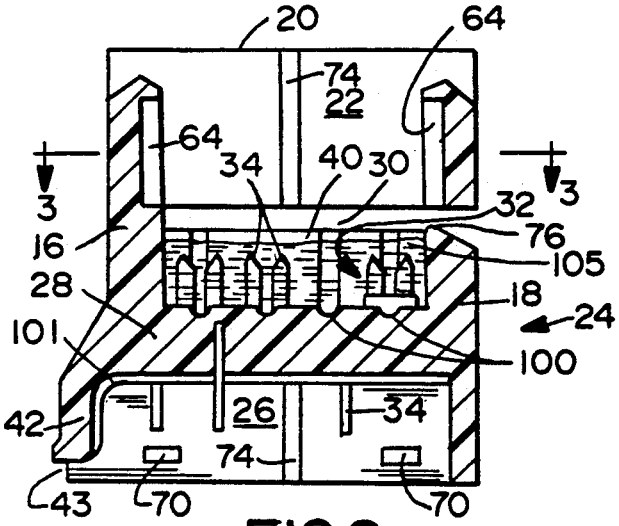
Figure 10:
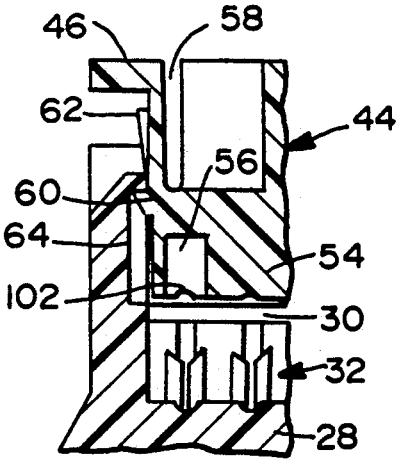
Figure 8:
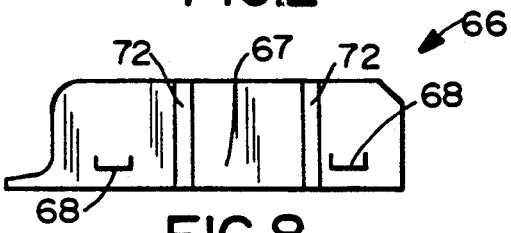
Figure 3:
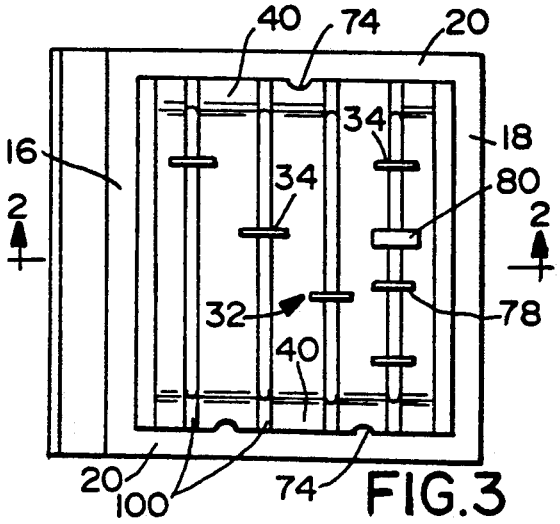
Figure 9:
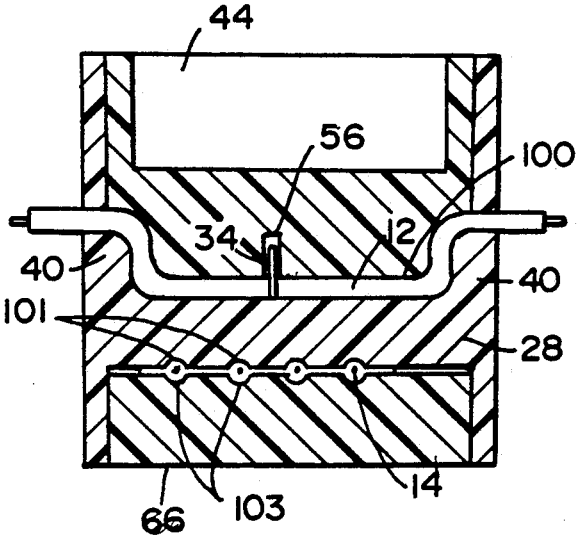

The invention is now described by way of example only with reference to the drawings in which:

FIG. 1 is a perspective view of the electrical conductor cable connector of the invention shown connecting two ribbon tape cables at right angles to each other, FIG. 2 is a sectioned side elevation of the connector housing shown sectioned on the line 2—2 in FIG. 3, FIG. 3 is a plan view of FIG. 2, FIG. 4 is a partially phantom perspective view of a single conductor connecting element of the connector of the invention shown connected to two insulated electrical conductors, FIG. 5 is a fragmentary end elevation of the upper portion of one of the conductor connecting element blade of FIG. 4, FIG. 6 is a sectioned side elevation of member shown in FIG. 1, the press FIG. 7 is an end elevation of the press member of FIG. 6, FIG. 8 is a side elevation of a second press member for use with the FIG. 2 and 3 housing, FIG. 9 is a sectioned end elevation of the cable connector of the invention in use, FIG. 10 is a fragmentary sectioned side elevation illustrating the first stage of engagement of the FIG. 6 press member with the FIG. 2 housing, FIG. 11 is a schematic electrical diagram illustrating the function of the cable connector of the invention, FIG. 12 is a fragmentary sectioned end elevation of a cable cutting blade arrangement in the connector housing.

Figure 14:
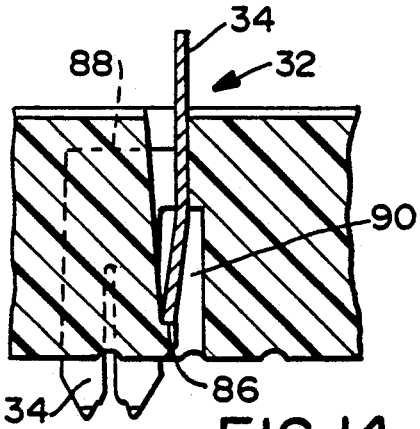
Figure 13:
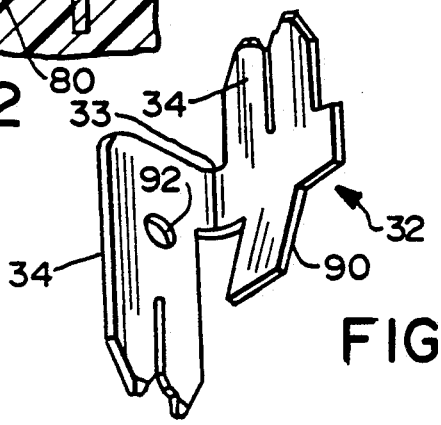

FIG. 13 is a perspective view of a second embodiment of the conductor connecting element of the invention, and FIG. 14 is a fragmentary sectional side elevation of the FIG. 13 connecting element shown located in the floor of the connector housing.

DETAILED DESCRIPTION OF THE PREFERRED EMBODIMENT

The cable connector 10 of the invention is shown in FIG. 1 to be connecting two multi-conductor ribbon tape cables 12 and 14 at right angles to each other.

The housing of the connector 10 of FIG. 1 is shown in FIGS. 2 and 3 to include side walls 18 and 18, opposite end walls 20 with a compartment 22 defined between the four walls and a lower portion indicated generally at 24. The lower portion 24 of the housing is recessed to provide a second compartment 28 which is located below and separated from the first compartment by a partition member 28.

The walls 18 and 20 of the housing compartment 22 are slotted to provide an entry slot 30 for the ribbon tape 12.

A plurality of conductor engaging elements 32, which are more clearly seen in FIG. 4 each include two oppositely directed blades 34 which are joined at right angles to each other by a connector strip 33. The conductor engaging elements 32 are punched from a common strip of electrically conductive sheet metal such as a suitable copper or brass alloy. As is more clearly seen in FIG. 5, the upper edge of each of the blades 34 includes spaced points for piercing the insulation of a ribbon tape on either side of one of the conductors of the tape, and a V-shaped formation 37 for guiding the conductor into a slot 38 while at the same time slicing through the insulation on either side of the conductor. The width of the slot 38 is very slightly narrower than the diameter of the conductor so that the conductor in the cut insulation is in firm physical engagement with the blade 34 when fully pressed into the slot 38. The edges of the cable locating V could include small ripper teeth 38 to facilitate cutting of the ribbon tape insulation as a conductor is pressed into the slot 36 of the blades 34.

The central portion of the conductor engaging elements 32 including the connector strip between the blades is embedded in the material of the partition member 28 with only the slotted portion of the blades 34 projecting from above and below the partition member 28 into the compartments 22 and 26 as shown in FIG. 2.

The conductor engaging elements 32, in the compartment 22, are each located across a groove 100 in the surface of the partition member 28 of the compartment 22 which extends, up and over a rounded surface 40 in the end walls 20 to the slot 30. The grooves 100 serve as locators for the conductor carrying portions of the ribbon tapes which are to be used with the connector. The surface of the partition member 28 of the compartment 26 is similarly grooved with grooves 101 running down and over a rounded surface 42 which forms a side wall of the compartment 26 to a tape outlet 43 from the compartment.

FIGS. 8 and 7 illustrate a press member 44 for use in pressing the ribbon tape 12 into the compartment 22 and into engagement with the conductor engaging elements 32 in the compartment. The press member is shown in the drawings to include side walls 45 and 48, opposite end walls 50 which are joined by a central rib 52 and a base portion 54.

The base 54 of the press member 44 is solid material and carries on its underside and its side walls grooves 102 which, when the press member is located in the compartment 22 of the connector housing are in register with the conductor locating grooves 100 on the surface of the partition member of the compartment and the rounded surfaces 40 and slots 56 which are in register with the conductor engaging elements 32 projecting from the surface of the partition member 28 of the compartment 22 and in which the blades 34 of the elements 32 are completely contained when the press member 44 is fully pressed into the compartment 22 to clamp the ribbon tape 12 in the compartment. The side walls 45 and 48 of the press member 44 are separated from the walls 50 by slots 58 which, due to the resilience of the plastics material from which the press member 44 is made, enable the walls 46 and 48 to be flexed inwardly towards the vertical edges of the malls 50 when the walls are pressed inwardly in the direction of the arrows in FIg. 6. Catch formations 60 and 62 are positioned on the outer surfaces of the side walls 46 and 48 as shown in FIG. 7. The inner surfaces of the side walls 16 and 18 of the connector housing 10 are recessed at 64, as shown in FIG. 2, to receive the catches 60 and 62, respectively of the press member 44.

FIG. 8 shows a second press member 66 for location in the compartment 26 of the lower portion 24 of the FIG. 2 housing. As is the case with the press member 44 of FIG. 6 conductor locating grooves 103 extend over the upper surface of the press member 66 (FIG. 9) and over onto its left hand vertical edge FIG. 8 and contains slots 104 (not shown) for receiving the blades 34 of the conductor engaging elements 32 in the compartment 28. The grooves 103 in the press member 66 are located to be in register with grooves 101 on the surface of the partition member 28 of the compartment 26 and the inner surface of the rounded surface 42 in the compartment 26. The compartment 26 grooves 101, like grooves 100 in compartment 22, are in register with the slots 36 in the blades 34 of the conductor engaging elements 32 in the compartment. The end walls 67 of the press member 66 include outwardly projecting catch formations 68 which, when the press member is fully pressed into the compartment 26 engage slots 70 in the end walls 20 of the compartment 26 to lock the press member 66 in the compartment. The press member 66 as is the case with that of FIGS. 6 and 7, includes on one end wall two vertical grooves 72 and on the opposite end wall a single centrally located groove, not shown. The purpose of the grooves on the two press members is to ensure that the press members and the slots 56 in them for receiving the conductor engaging blades 34 are correctly oriented by keying with inwardly projecting ribs 74 on the inner surfaces of the end walls of the compartments 22 and 26.

In use, the compartments 22 and 25 of the connector 10 are at least partially filled with a water resistant highly viscous grease 105. The ribbon tape 14 is located in the compartment 26 with its free end up against the wall 20 on the right hand side of the compartment. The width of the compartment 26 conveniently corresponds to that of the ribbon tape 14 so that the raised conductor carrying portions of the ribbon tape insulation are located under the grooves 101 and conductor engaging element blades 32 in the compartment. Alternatively, the compartment could be wider than the tape 14 but would then include one or more stops on the surface of the partition member 28 to accurately locate the tape 14. The press member 66 is then located over the mouth of the compartment 26 with the grooves 72 engaged with the locating ribs 74 on the inner surfaces of the end walls of the compartment. The press member 66 is then pressed, conveniently by a suitable tool, into the compartment 26 to press the ribbon tape 14 over the blades 34 which cut through the insulation on the sides of the conductors 14 in the tape and press the conductors into the slots 36 in the blades. The catch formations 68 on the end walls of the press member 66 are pressed, by resilient deformation of the catch formations and/or deformation of the walls 20 over the inner surfaces of the recess end walls until they enter the slots 70 with the upper surface of the press member bearing on the ribbon tape 14. The raised conductor insulation of the tape 14 is now firmly located in the grooves 101 in the partition member 28 and in the grooves 93 of the press member. The rounded surface 42 is dimensioned to be almost a friction fit with the left hand vertical side wall of the press member 66 so that the ribbon tape 14 is firmly pressure clamped in the compartment 26 between the vertical side of the press member and the rounded surface 42 to lock the ribbon tape in the compartment against any stress applied to the ribbon tape on the outside of the cable connector 10.

With the ribbon tape 14 now located in the compartment 26 and its conductors in electrical contact with the conductor engaging element blades 34 in that compartment the press member 44 is pressed into the recess 22 of the housing until catches 60, again by resilient deformation of the material of the press member, enter the recesses 64 in the walls 16 and 18 of the housing. With the catches 60 engaged in the recesses 64 the underside of the base 54 of the press member is position above the upper edge of the slot 30 in the housing 10 as shown in FIG. 10.

At its place of use the ribbon tape 12, to which one or more of the connectors 10 are to be connected, is slid sideways into the slot 30 until its leading edge abuts the end of the slot 30 in the compartment 22. The entrance to the compartment could, as shown in FIG. 2, include a flared mouth which terminates in a very slightly raised projection 76 over which the ribbon tape 12 is frictionally moved into the slot 32 and which, once in the slot, engages the outer edge of the tape 12 accurately to locate the tape in the slot 30 with its raised conductor insulation over the grooves 100 in the partition member 28 and on the base 54 of the press member 44. As has been mentioned previously, the grooves 72 (not shown) in the press member 44 which are keyed with the ribs 74 on the end walls 20 of the compartment 22 ensure that the slots 56 in the base of the press member are located directly over the blades 34 of the conductor engaging elements 32 in the compartment. The press member 44 is the pressed downwardly into the compartment 22 with the side walls 46 and 48 hinging inwardly to permit the catches 62 to engage in the recesses 64 in the side walls of the housing to lock the press member 44 in the housing in pressure contact with the ribbon tape 12. The ribbon tape conductors, as described with reference to the compartment 26, are now firmly located in the slots 36 of the blades 34 in the compartment 22. As will be seen from FIGS. 7 and 9 the side walls of the base 54 of the press member are rounded to complement the rounded surfaces 40 in the compartment 22. The side walls of the press member base 54 are dimensioned, as is the case with the rounded surface 42 of the compartment 26, to clamp the ribbon tape 12 firmly between the press member 44 and the vertical portions of the rounded surfaces 40 against movement in the compartment by stress imposed on the ribbon tape 12 on the outside of the connector. This is illustrated in FIG. 9 which more clearly illustrates the direction changing clamping surfaces on both the housing and press member 44.

To release the cable connector of the invention from the ribbon tape 12 the side walls 46 and 48 of the press member 44 are pressed inwardly in the direction of the arrows in FIG. 6 to clear the catches 62 of the recesses 64 in the walls 16 and 18 of the housing and, when cleared, the press member 44 is pulled out of the compartment 22 until the catches 60 abut the upper edges of the recesses 64. The ribbon tape 12 may then merely be tensioned to lift it from the conductor engaging element blades 34 and, when straightened, is pulled out through the slot 30 in the connector housing.

In some applications, it may be desirable to open circuit one of the ribbon tape conductors in the connector as illustrated in FIG. 11. To achieve this, as shown in FIGS. 2, 3 and 12, a blade 78 is embedded in the partition member 28 of the housing to project into one of the compartments, in this case compartment 22, with its sharpened upper edge projecting into the compartment. The press member 44 includes a recess 79 for receiving the sharpened edge of the blade in use as illustrated in FIG. 12. The blade 78 is located in the conductor path between two blades 34 of linearly spaced conductor engaging elements 32 with a projection 80 on the partition member 28 extending across the conductor insulation groove 100 between the blade 78 and one of the blades 34. The underside of the press member 44 includes a complementally shaped recess 82, as shown in FIGS. 2 and 6, in which the projection 80 is located in use. As the press member 44 now presses the ribbon tape 12 down onto the surface of the partition member 28 of the compartment 22 the blade 78 severs the conductor in whose path it lies with the conductor being deformed and shortened by the action of projections 80 entering recess so that the severed conductor is 82 out of electrical contact with the blade 78 to ensure a clean open circuit 84 as shown in FIG. 11. The open conductor on either side of the break is now connected, through the blades 34 on either side of the cutting blade 78, to conductors on the ribbon tape 14. It will be noticed from FIG. 11 that the ribbon tape 14 in this drawing includes five conductors whereas the connector, as shown in the remaining drawings, has provision only for four. This is not amiss as the connector of the invention could be designed for any reasonable width of ribbon tape having however many electrical conductors are required for a specific application.

The invention is not limited to the precise details as herein described. For example as an alternative to the conductor engaging elements 32 being moulded into the partition member 28 of the housing, the floor could include, as shown in FIG. 14, an L-shaped recess into which the elements 32 are pressed on completion of the plastics moulding process. One of the legs of the L extends through the partition member 28 and is shaped as shown in the drawing to include a step 86. The portion of the recess defining the outer leg of the L extends from the underside of the partition member 28 to terminate at surface 88 below the surface of the partition member 28. The conductor engaging elements 32 in this application are modified from that of FIG. 4 in that they include a locking tang 90 which extends downwardly and inwardly from the base of one of the blades 34, as shown in FIG. 13, and a dimple 92 on the remaining blade 34. With the conductor engaging elements 32 held as shown in FIG. 13 they are pressed into the L-shaped recesses in the underside of the partition member 28 until the upper blade 34 projects from the surface of the member 28 and the lower edge of the locking tang 90 engages over the recess step 86, as shown in FIG. 14, to lock the element 32 in the recess. The dimple 92 serves to present the other blade 34 against flexing its recess.

Additionally, the conductor cutting blade 78 described with reference to FIGS. 11 and 12 could be fixed to the press member 44 in place of the partition member 28 with the blade receiving recess 82 located in the partition member 28.

We claim:

1. An electrical conductor cable connector comprising:

a housing of an electrical insulating material, the housing having side walls and a lower portion defining an first open ended compartment, a plurality of conductor engaging elements mounted in the lower portion and extending into the first compartment, each element having a portion located in the lower portion of the housing for electrically connecting an electrical conductor located in the lower portion of the housing to the conductor engaging element, the connector housing having a slot which extends from one side of the housing through the walls of the first compartment above the conductor engaging elements, the slot adapted to receive a first ribbon tape cable having a plurality of insulation covered electrical conductors, a first press member of an electrical insulating material slidably mounted in the first compartment for pressing the first cable against the conductor engaging elements located in the first compartment, means for locking the first press member in a first position in the first compartment such that the first member is located above the slot, the first cable adapted to be introduced into the slot and terminated to the conductor engaging elements without removal of the first press member, means for clamping the first cable to the housing, and means for locking the first press member in a second position in the first compartment to maintain the first cable clamped to the housing.

2. An electrical conductor cable connector as claimed in claim 1 wherein the lower portion of the housing includes a second open ended compartment opposite to the first compartment, the second compartment adapted to receive a second ribbon tape cable having a plurality of insulation covered electrical conductors, each of the conductor engaging elements including a first blade extending substantially perpendicularly into the first compartment and a second blade extending substantially perpendicularly into the second compartment, the second blade directed opposite to the first blade and located in a plane substantially perpendicular to the plane containing the first blade, each blade includes a cutting edge for cutting insulation on a said electrical conductor when pressed into said blade and a slot for electrically engaging said conductor, a second press member adapted to slidably enter the second compartment for pressing the second ribbon tape cable against the second blades extending into the second compartment, the first and second press members having slots to accommodate the first and second blades, respectively, and means for locking the second press member in the second compartment.

3. An electrical conductor cable connector as claimed in claim 2 in which a partition member between the two compartments includes L-shaped slots in which the conductor engaging elements are located with each slot including in its length through the partition member a catch formation and each conductor engaging element including a tang which is located on one of said first or second blades and engaged with the catch formation in the slot to lock the element in the slot with said first or second blades projecting from opposite faces of the partition member, the other of said first or second blades having a projection extending from one of its surfaces to firmly wedge that blade in the slot.

4. An electrical conductor cable connector as claimed in claim 3 including clamping means between the connector housing in the compartments and the respective press members for clamping the ribbon tape cables in the respective compartments.

5. An electrical conductor cable connector as claimed in claim 4 in which the ribbon tape cable clamping means includes at least one tape direction changing surface between the housing in each compartment and each press member between which the ribbon tapes are clamped.

6. An electrical conductor cable connector as claimed in claim 2 in which the housing compartments are filled with a flowable liquid sealant.

7. An electrical conductor cable connector as claimed in claim 1 including a cutting blade which extends from the partition member into the first compartment for cutting and so open circuiting a pre-selected cable conductor when pressed by the first press member into the compartment with a conductor engaging element on at least one side of the cutting blade in the path of the pre-selected conductor through the housing for electrically engaging the conductor on one side of the blade, further including means for deforming said pre-selected conductor to ensure that at least one cut end of the conductor is not in electrical contact with the cutting blade.

8. An electrical conductor cable connector as claimed in claim 7 wherein the deforming means includes a projection extending from the partition member into the compartment in the path of the pre-selected conductor and wherein the press member has a recess in its base adapted to accommodate the projection and a portion of the conductor engaged by the projection.

* * * * *